US006648155B1

(12) United States Patent
Wang

(10) Patent No.: US 6,648,155 B1
(45) Date of Patent: Nov. 18, 2003

(54) DISPLAY RACK

(76) Inventor: Huei-Ming Wang, No. 34, Lane 611, Shui Yuan Rd., Feng Yuan City, Taichung Hsien (TW)

( * ) Notice: Subject to any disclaimer, the term of this patent is extended or adjusted under 35 U.S.C. 154(b) by 0 days.

(21) Appl. No.: 10/190,010

(22) Filed: Jul. 8, 2002

(51) Int. Cl.[7] ..... A47B 57/18
(52) U.S. Cl. ..... 211/187; 108/107; 108/147.15
(58) Field of Search ..... 211/187, 186, 211/182; 108/106, 107, 110, 147.11, 147.15, 147.16, 153.1; 312/265.4, 111; 248/125.8, 413

(56) References Cited

U.S. PATENT DOCUMENTS 870,681 A * 11/1907 Karges ..... 108/106
2,894,642 A * 7/1959 Clevett, Jr. ..... 108/106
3,173,385 A * 3/1965 Tucker ..... 108/106
3,756,168 A * 9/1973 Bushyhead ..... 108/106
4,469,232 A * 9/1984 Lusch ..... 211/189
4,760,800 A * 8/1988 Hanson ..... 108/152
5,014,952 A * 5/1991 Petrohilos ..... 248/250
5,542,530 A * 8/1996 Freelander ..... 108/106
5,810,457 A * 9/1998 Felsenthal et al. ..... 108/106

* cited by examiner

*Primary Examiner*—Daniel P. Stodola
*Assistant Examiner*—Erica B Harris
(74) *Attorney, Agent, or Firm*—Charles E. Baxley

(57) ABSTRACT

A display rack includes two main frames (1) with a top rail (12) and a bottom rail (13). A shelf (3) has two sidebars (31) and each sidebar has two holes (311) for four posts (2) extending therethrough and connected between the top rail and the bottom rail. A threaded hole (321) is defined in each end of each of the sidebars and communicates with the hole corresponding thereto. Four bolts (33) respectively extend through the threaded holes and contacting the posts to position the shelf.

2 Claims, 4 Drawing Sheets

DISPLAY RACK

The present utility model relates to a rack that has shelves connected to posts by side bolts contacting against the posts and the positions of the shelves are easy to adjust.

A conventional rack for displaying products in stores generally includes a several posts with a plurality of shelves connected between the posts horizontally. Products are put on the shelves and can be easily accessed. The shelves are fixed to the posts by way of welding for example and the positions of the shelves cannot adjusted conveniently.

The present utility model relates to a display rack which includes two main frames each have a top rail and a bottom rail. Four posts extend through holes in two sidebars of a shelf and are connected between the top rail and the bottom rail. A threaded hole is defined in each end of each of said sidebars and communicates with said hole corresponding thereto. Four bolts respectively extend through said threaded holes and contact said posts.

The primary object of the present utility model is to provide a display rack wherein the shelves are easily to be adjusted their positions.

The present utility model will become more obvious from the following description when taken in connection with the accompanying drawings.

IN THE DRAWINGS

Figure 1:
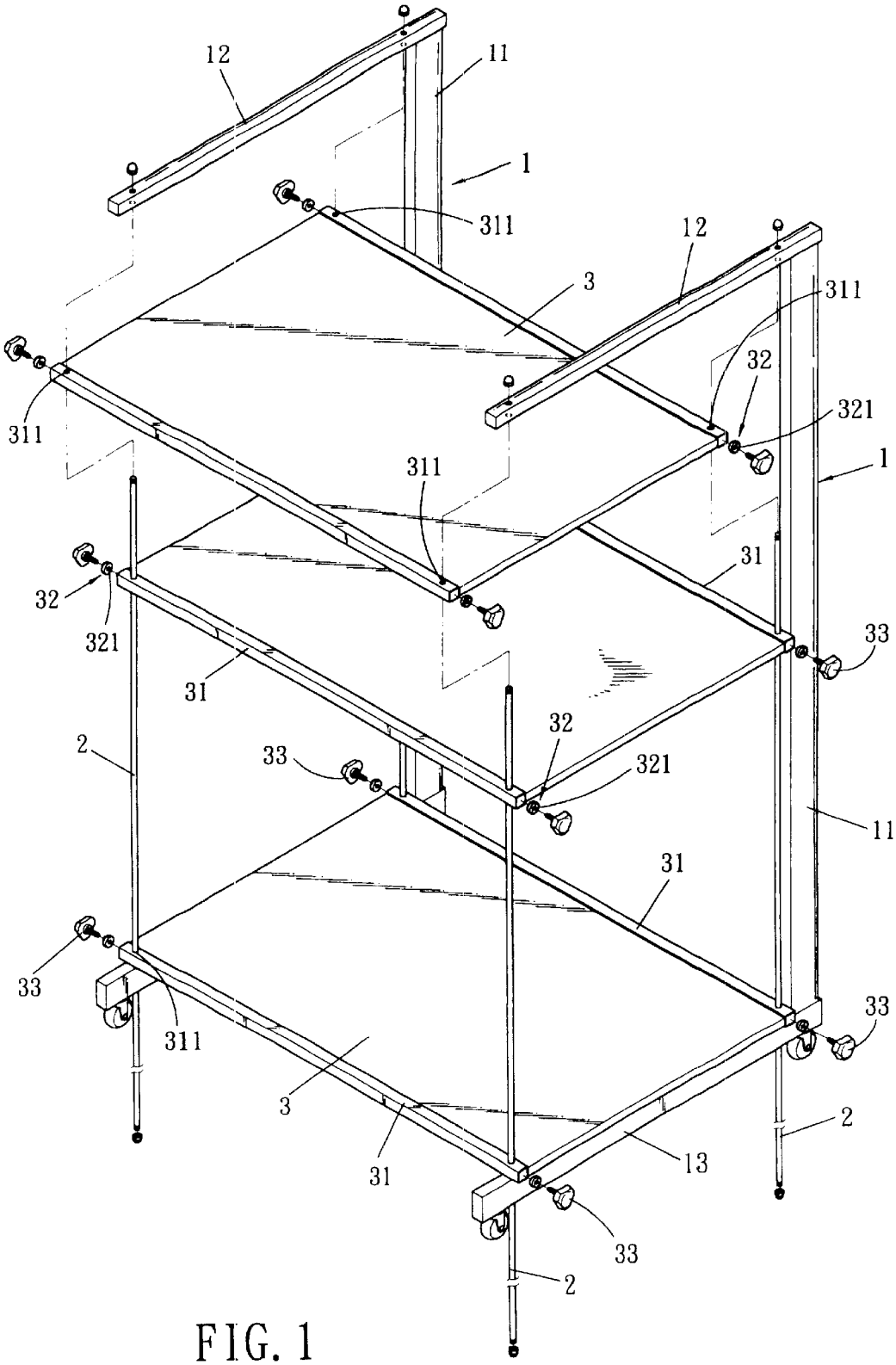
FIG. 1 is an exploded view to show the display rack of the present utility model.
Figure 2:
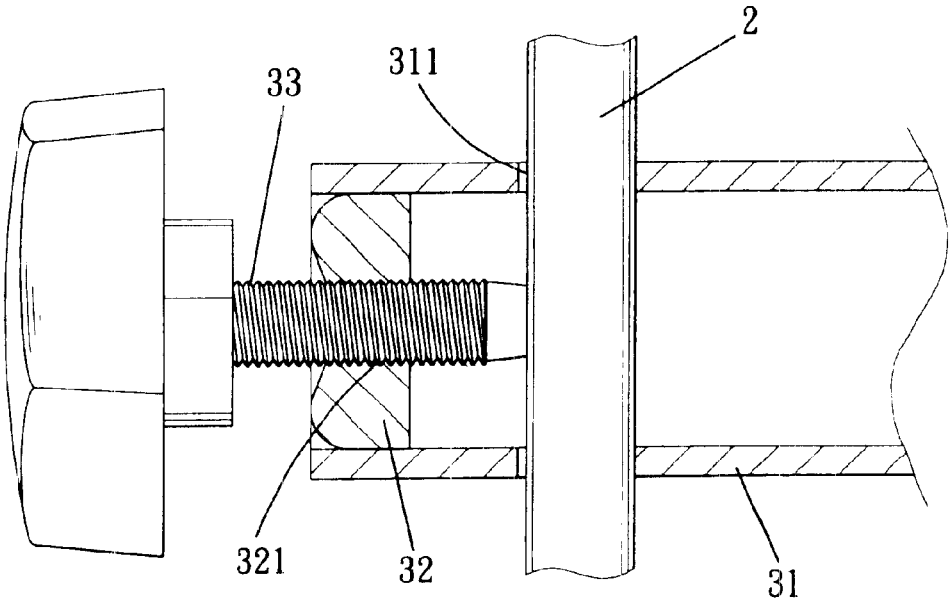
FIG. 2 is a cross sectional view to show the bolt extends through the threaded hole and contacts the post.
Figure 3:
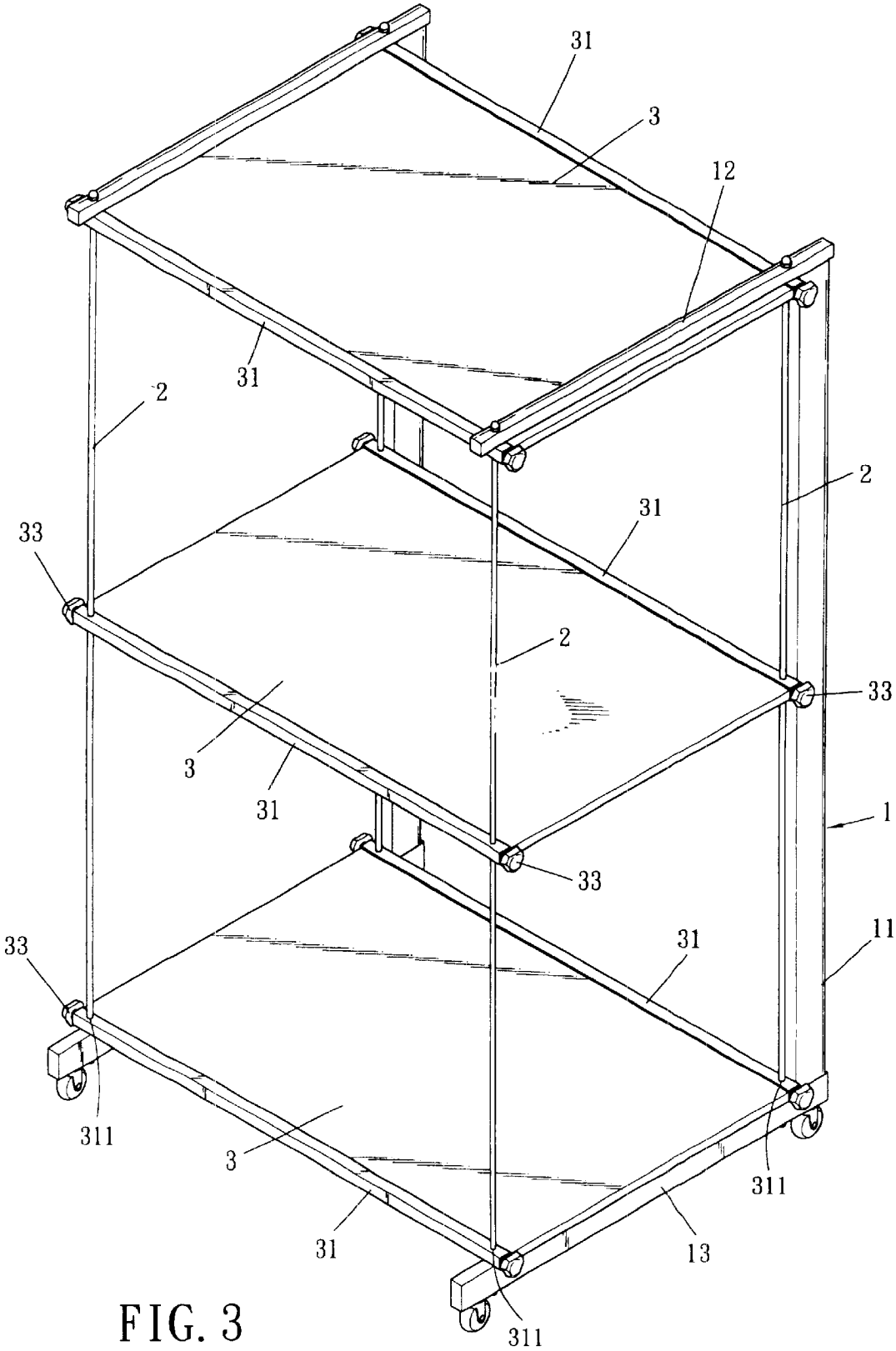
FIG. 3 is a perspective view to show the display rack of the present utility model.

Referring to FIGS. 1 to 3, the display rack of the present utility model comprises two main frames 1 and four posts 2, and three shelves 3 are connected between the four posts 2. Each of the main frames 1 includes a central bar 11 with a top rail 12 and a bottom rail 13 extending transversely from a top end and a bottom end of said central bar 11.

Each shelf 3 has two sidebars 31 and each sidebar 31 has two holes 311 so that said four posts 2 extend through said holes 311 of said two sidebars 31 and are connected between the top rails 12 and said bottom rails 13.

A nut 32 with a threaded hole 321 defined therein is secured in each end of each of said sidebars 31 and communicates with said hole corresponding thereto. Four bolts 33 respectively extend through said threaded holes 321 and contact said posts 2 to position the shelves 3. The positions of the shelves 3 can be conveniently adjusted by unscrewing the bolts 33 to slide the shelves 3 along the posts 2 and re-locking the bolts 33 when the shelves 3 are moved to desired heights.

Figure 4:
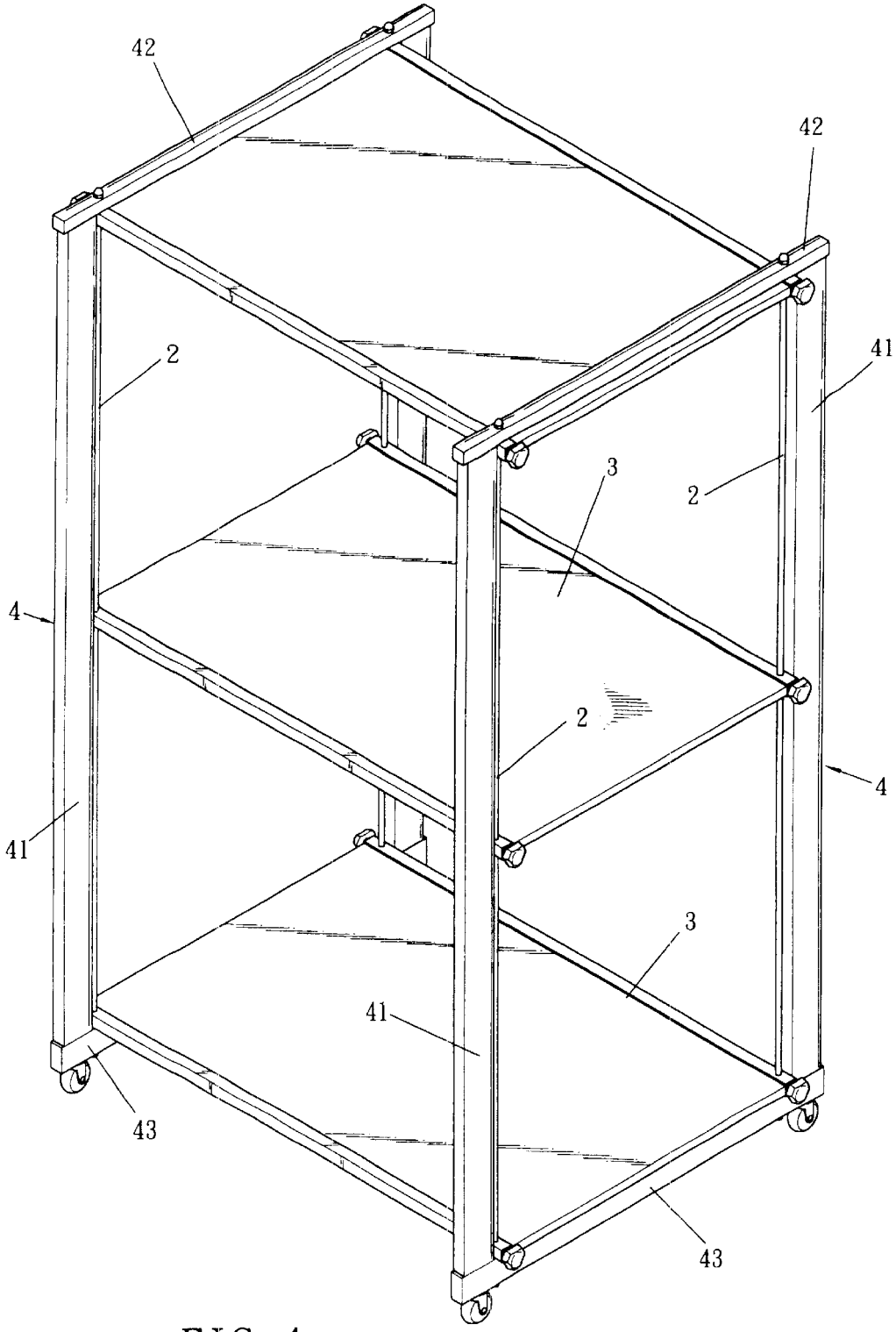
FIG. 4 is a perspective view to show that the display rack of the present utility model has four main frames.

As shown in FIG. 4, the display rack may have four main frames 4 and each have a central bar 41. The two top rail 42 and the two bottom rails 43 are connected between the two main frames 4.

While we have shown and described the embodiment in accordance with the present utility model, it should be clear to those skilled in the art that further embodiments may be made without departing from the scope of the present utility model.

What is claimed is:

1. A display rack comprising:

two main frames each having a top rail and a bottom rail extending transversely therefrom;

four posts;

a shelf having two sidebars and each sidebar having two holes, said posts extending through said holes of said two sidebars and connected between said top rail and said bottom rail, a threaded hole defined in each end of each of said sidebars and communicating with said hole corresponding thereto, and four bolts respectively extending through said threaded holes and contacting said posts.

2. The rack as claimed in claim 1, wherein said threaded hole is defined in a nut which is secured in each end of each of said sidebars.

* * * * *